US011352202B2

(12) United States Patent
Van Der Berg

(10) Patent No.: US 11,352,202 B2
(45) Date of Patent: Jun. 7, 2022

(54) FOLDABLE FRAME FOR CONTAINERS AND HINGED MEMBER THEREFOR

(71) Applicant: IPGO EUROPE KFT., Szentendre (HU)

(72) Inventor: Robertus Joannes Van Der Berg, Cruquius (NL)

( * ) Notice: Subject to any disclaimer, the term of this patent is extended or adjusted under 35 U.S.C. 154(b) by 41 days.

(21) Appl. No.: 16/652,247

(22) PCT Filed: May 9, 2018

(86) PCT No.: PCT/HU2018/050018
§ 371 (c)(1),
(2) Date: Mar. 30, 2020

(87) PCT Pub. No.: WO2019/064036
PCT Pub. Date: Apr. 9, 2019

(65) Prior Publication Data

US 2020/0239225 A1 Jul. 30, 2020

(30) Foreign Application Priority Data

Sep. 28, 2017 (HU) ..... P1700398

(51) Int. Cl.
*B65D 6/18* (2006.01)
*B65D 88/52* (2006.01)

(52) U.S. Cl.
CPC ..... *B65D 88/524* (2013.01)

(58) Field of Classification Search
CPC .. B65D 88/521; B65D 88/022; B65D 88/121; B65D 88/52; B65D 90/0086; B65D 90/0026; E05D 3/12; E05Y 2900/604
USPC ..... 220/4.28, 4.29, 6, 7, 4.33
See application file for complete search history.

(56) References Cited

U.S. PATENT DOCUMENTS 7,870,970 B2 * 1/2011 Fisk ..... B65D 90/0086 220/7

* cited by examiner

*Primary Examiner* — Don M Anderson
*Assistant Examiner* — Elizabeth J Volz

(57) ABSTRACT

A foldable frame for containers has a polygonal base mount made of studs and an upper mount parallel to the base mount made of studs. The polygonal base mount and the upper mount are connected together by means of columns of equal length. The columns are formed of at least two sections of the same length, and the adjacent sections are joined together by a hinged member, the hinged member containing a first bushing connected to a slider movably disposed in the cavity of the first section, a second bushing having common axle with the first bushing and secured to the locking member arranged in the inner cavity of the adjacent second section, with a hinge pin provided in the bushings.

5 Claims, 10 Drawing Sheets

FOLDABLE FRAME FOR CONTAINERS AND HINGED MEMBER THEREFOR

CROSS-REFERENCE TO RELATED APPLICATIONS

The present application is a national stage entry of International Patent Application No. PCT/HU2018/050018, filed on May 9, 2018, which claims priority to Hungarian Patent Application No. P1700398, filed on Sep. 28, 2017.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

Field of the Invention

The invention relates to a foldable frame for containers having a polygonal base mount made of studs, and a polygonal upper mount parallel to the base mount made of studs and having a number of angles equal to those of the base mount, and said mounts are connected together by means of columns of equal length attached with hinges to corner blocks provided at connections of the studs, and the columns are formed of at least two sections of the same length and the adjacent sections are joined together by a hinged member, and a hinged member formed with a first bushing connected to a sliding block, a second bushing having common axle with the first bushing and secured to the sliding block, and a hinge pin provided in the bushings, and a sliding guide is provided on at least one sliding block.

Brief Description of Related Art

In recent decades, the use of containers has been almost exclusively made by sea, rail and, therefore, partly in road freight as the costs of commercial transportation can be drastically reduced by avoiding intermediate loading costs. Transferring the freight container from one vehicle to another is a cheap and fast solution. Containers can be transported directly from the harbor on trucks and/or trains. Containers are suitable for transporting of long distance and large mass freight, regardless of the type of goods, so their use is widespread and standardized.

As a result of the rapid increase in the use of containers, storing spaces had to be built for empty containers. The temporary storage of a large number of empty containers required new investments in the ports, while the transport of empty containers reduced the efficiency of container transport, because it had the same transport capacity as the container fully loaded with goods.

In the past decades, several attempts have been made to solve the problem. As a result, foldable containers have been created, the volume of which in collapsed condition significantly reduces the space requirement of the transport and thus the specific cost thereof.

For example such a solution is disclosed by the patent document US 20160039603A1. The folding containers according to the solution can be stacked after collapsing. The container contains floor plate, roof plate, back plate, front plate and longitudinal sidewalls split in half along with their lengths that are joined to each other along their common edges, with pivoted hinges. When the container is collapsed, the back plate and the element forming the front plate are first folded to the floor plate and the longitudinal side walls tend to align to the floor plate by their central hinges, while the roof plate retained by a lifting device is lowered. The container is set in reverse order. The disadvantage of the solution primarily is that a solid and reliable fixing of the longitudinal sidewall bands of the set container requires complicated and cumbersome fastening means that forms separate elements.

Publication document WO9928215A1 discloses a similar solution but it does not require complicated fasteners for solid and reliable mounting of longitudinal sidewall bands of the mounted container. However, the disadvantage of the solution is that the fasteners of the container set up are readily accessible by unauthorized persons and therefore unsafe.

For container according to document U.S. Pat. No. 4,848,618, means for fastening the longitudinal foldable sidewall is, therefore, inside the container and thus makes it impossible unauthorized access, if the container is properly closed. The disadvantage of the solution is, firstly, that for opening of the fastener one must enter the container to be folded, which can be dangerous even proper precautionary measures are taken.

With the widespread use of the transport containers made from load-bearing frame, sidewalls and freight doors arranged usually on the short sidewalls, other use of the containers beside the freight transport has also begun to be utilized. Containers having traditional frame but equipped with doors, windows on the side walls and with other auxiliary devices, which are customized for work or even residential space, are suitable for creating temporary installations, installing parade buildings, creating temporary or permanent residence systems. By combining such containers one can even build container assemblies for quick installations. Also with containers for such purposes it is important as well that the transport of empty containers and the storage of unused containers can be achieved in a collapsed state, which greatly increases the efficiency of use. However, for these containers technical solutions according to the state of the art cannot be considered achievable, since the basic requirement is not only to allow the container to be set up quickly and safely, but also to prevent unauthorized persons from being able to access to and dismantle the hinges and fixing means of the container frame by hand either from the outside or inside the container.

SUMMARY OF THE INVENTION

Therefore, the object of the present invention is to provide a foldable container frame, whose fixing and hinged elements are inaccessible to the user of the installed container and can be detached only by mechanical force. The container frame may be equipped for different purposes, for example with solid shell that is sidewalls, roof and floor plates and cargo doors for carriage of goods, or with side walls provided with doors and windows or other openings in addition to the roof and floor panels for work and residential installations, but the frame itself it can be used without side walls, roof and floor plates e.g. for transport and storage of vessels or for applications that do not require any shell on the frame.

In addition, our further object is to provide a container frame that can be installed and latched quickly and easily and both dismantling and folding of the container frame would be quick, simple, economic and safe at the same time.

Above objects can be achieved by providing a foldable frame for containers having a polygonal base mount made of studs, and a polygonal upper mount parallel to the base mount made of studs and having a number of angles equal to those of the base mount, and said mounts are connected together by means of columns of equal length attached with hinges to corner blocks provided at connections of the studs, and the columns are formed of at least two sections of the same length and the adjacent sections are joined together by a hinged member, and at least one of adjacent sections is provided with an inner cavity, and the hinged member contains: a first bushing connected to a sliding block movably disposed in the cavity of the first section, a second bushing having common axle with the first bushing and secured to a locking member arranged at least in part in the inner cavity of the adjacent second section, and a hinge pin provided in the bushings.

The sliding block arranged in the inner cavity of the second section is secured to the second section of the column.

A guide for restricting the displacement of the sliding block is fixed in the inner cavity of at least one section, and a stopper is formed on the sliding block.

There is such a relative angular position of the hinged member and the column around the axis, at which a smallest distance of the outer walls of the sections is smaller than the distance of the shaft and the axis of the hinge pin.

Our aim can also be achieved by providing a hinged member formed with a first bushing connected to a sliding block, a second bushing having common axle with the first bushing and secured to the sliding block, and a hinge pin provided in the bushings, and a sliding guide is provided on at least one sliding block.

At least one sliding block is provided with a stopper.

The sliding block is provided with a latch head.

BRIEF DESCRIPTION OF THE SEVERAL VIEWS OF THE DRAWINGS

The invention will be disclosed in details with reference to drawing as attached. In the drawing.

DETAILED DESCRIPTION OF THE INVENTION

Figure 1:
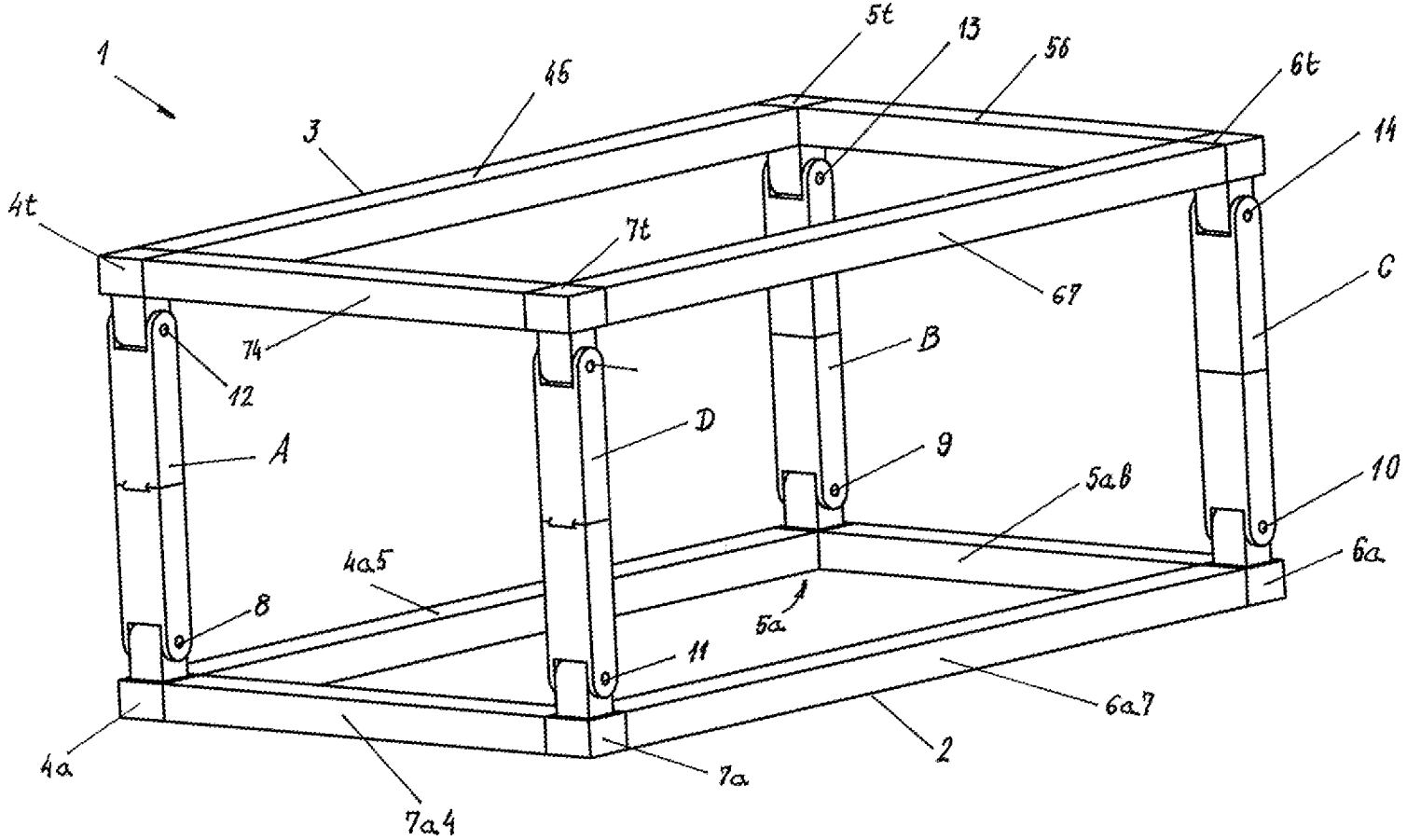
FIG. 1 shows a preferred embodiment of a foldable container frame according to the present invention in perspective view.

In FIG. 1, a preferred embodiment of a foldable container frame 1 according to the present invention can be seen in perspective view. The container frame 1 generally has a polygonal base mount 2 being rectangular in the illustrated embodiment, as well as a rectangular upper mount 3 arranged in a plane parallel to the base mount 2. Of course, it is possible that mounts 2,3 are square or multiangular shaped polygons or even an infinite polygon, i.e. a circle, but the shape of the base mount 2 and the upper mount 3 is always the same, e.g. for regular hexagonal base mount 2 the shape of the upper mount 3 is a regular hexagon as well. The corners of the frames 2,3 are formed by corner blocks 4*a*, 5*a*, 6*a*, 7*a*, 4*t*, 5*t*, 6*t*, 7*t*, whereby the container frame 1 can be lifted or fixed to the loading platform of a vehicle. The corner blocks 4*a*, 5*a*, 6*a*, 7*a*, 4*t*, 5*t*, 6*t*, 7*t* are therefore advantageously standardized. Corner blocks are connected with upper studs 45,56,67,74 in the upper mount 3 and with lower studs 4*a*5, 5*a*6, 6*a*7, and 7*a*4 in the base mount 2 along the edges of the respective mounts 2, 3. In the embodiment shown in Figure, the mounts 2,3 are connected to each other by columns A, B, C, D at the corner blocks 4*a*, 5*a*, 6*a*, 7*a*, 4*t*, 5*t*, 6*t*, 7*t*, as shown. Each of the columns A, B, C, and D is connected to the base mount 2 with a hinge 8, 9, 10, 11 at its bottom end, and with a hinge 12,13,14,15 to the upper mount 3 at its top end. The axles of the hinges 8, 9, 10, 11, 12, 13, 14, 15 are mutually parallel with each other in this embodiment, and with the plane of the mounts 2, 3 in all embodiments.

Figure 2:
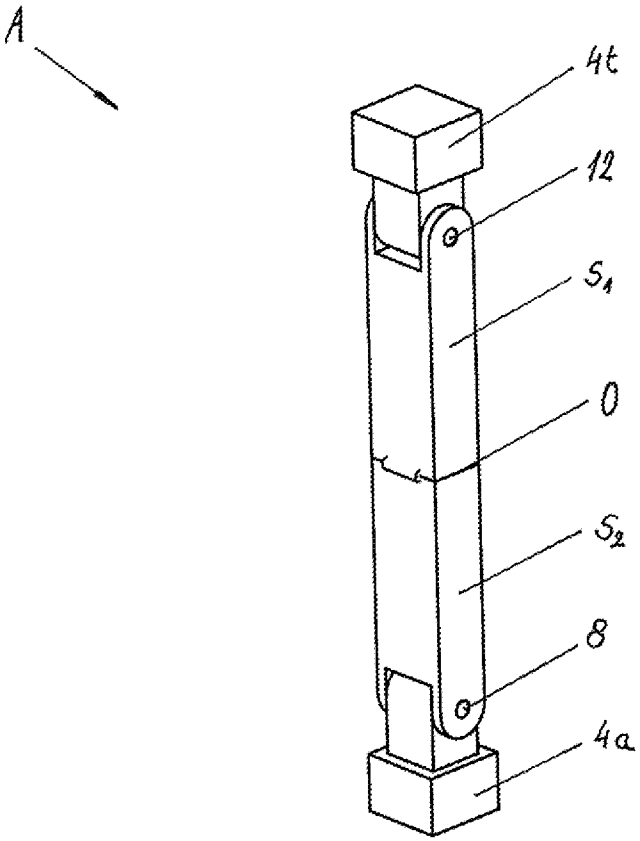
FIG. 2 shows one of columns in erected position of the foldable container frame according to the present invention in perspective view.

In FIG. 2, for the sake of simplicity, only one of columns A, B, C, D having the same design column A is shown in the erected position of the foldable container frame 1 according to the present invention. Column A and thus columns B, C and D as well are formed by two sections S1, S2 of the same length, where length of section S1 is measured between a hinge 12 and parting O, length of section S2 is measured between hinge 8 and parting O for column A, while for example, between hinge 13 and parting O, and hinge 9 and parting O for the column B, and so on. The two sections S1, S2 are preferably at least partially hollow tubes, e.g. hollow closed sections in the illustrated embodiment.

Figure 3:
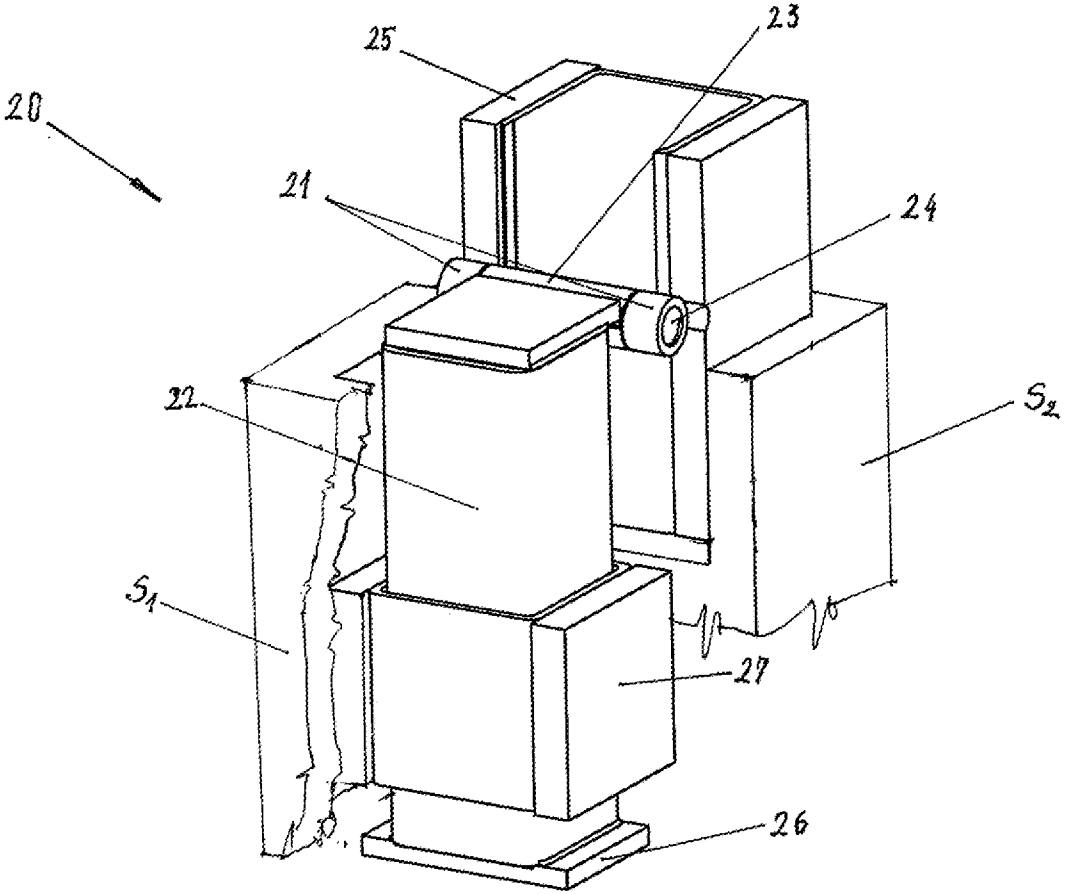
FIG. 3 shows a preferred embodiment of the hinged member according to the present invention inserted in the sections S1, S2 in open state.

FIG. 3 shows a preferred embodiment of the hinged member 20 according to the present invention inserted in the sections S1, S2 in open state, in a perspective view. In this position, the container frame 1 is in a collapsed state for transport. The hinged member 20 is provided with a first bushing 21, or with a first pair of bushings 21 in the embodiment shown, which is secured to a locking member 25. The locking member 25 is secured in section S2 of column A. In the bores of the pair of bushings 21 a pivot pin 24 is provided, which is surrounded by a second bushing 23 between the bushings 21 and secured to a sliding block 22. At the bottom of the sliding block 22, there is preferably a stopper 26. Between the stopper 26 and the pivot pin 24, a guide 27 may be slid along the sliding block 22, which is secured in the section S1 of column A.

Figure 4:
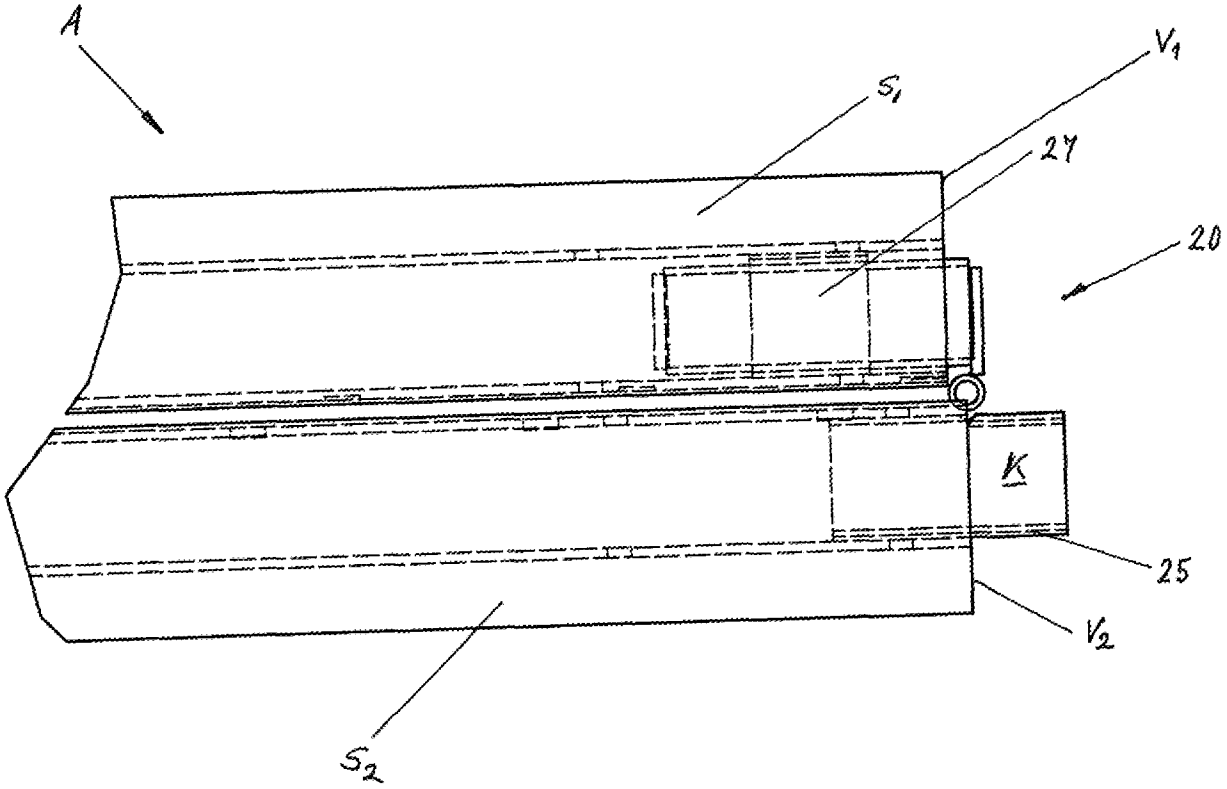
FIG. 4 shows a hinged member according to the invention as shown in FIG. 3 in open state built in the sections of a column of the container frame.
Figure 5:
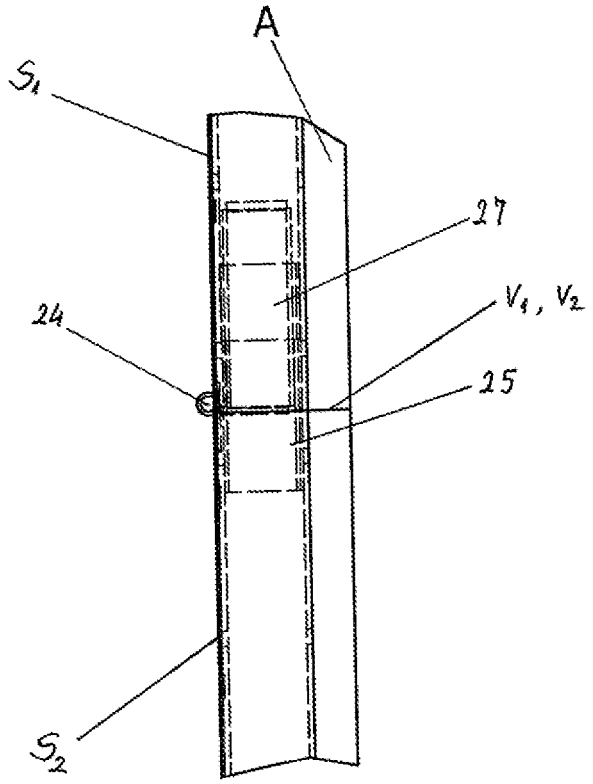
FIG. 5 shows a hinged member according to the invention as shown in FIG. 3 in closed state of the column, FIG. 6*a, b, c* show a hinged member as a further embodiment of the hinged member of the present invention in closed (6*a*), built in and closed (6*b*) state, as well as open (6*c*) state.

In FIG. 4 a hinged member 20 according to the invention as shown in FIG. 3 can be seen in open state built in the sections S1, S2 of column A. A hinged member 20 is mounted in the columns B, C, D in the same way. The guide 27 of the hinged member 20 is positioned and fixed in the interior of the section S1 in such a way that, in the closed position of column A as shown in FIG. 5, at least a portion or preferably the whole of the part K of the locking member 25 projecting from the end surface V2 of the section S2 can fit between the end surface of V1 of section S1 and the guide 27 such that the end surfaces V1, V2 of the sections S1, S2 of column A lean against each other. Therefore, in the position shown in FIG. 5 the sections S1, S2 of column A cannot be turned around, i.e., the column A cannot be folded about the hinge pin 24 so the column A is in a closed and locked position.

Figure 6A:
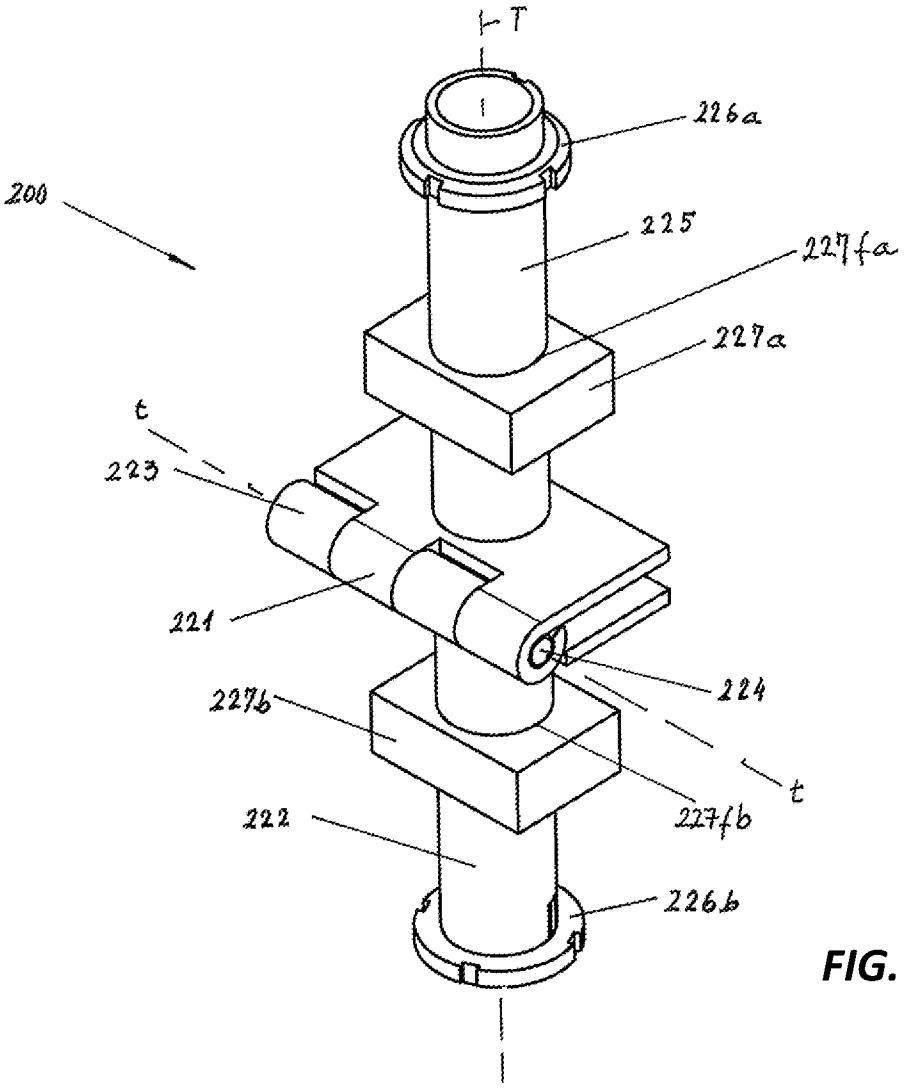
FIG. 6*d* shows a further embodiment of hinged member shown in FIG. 6*c*, which is provided with a locking head.
Figure 6B:
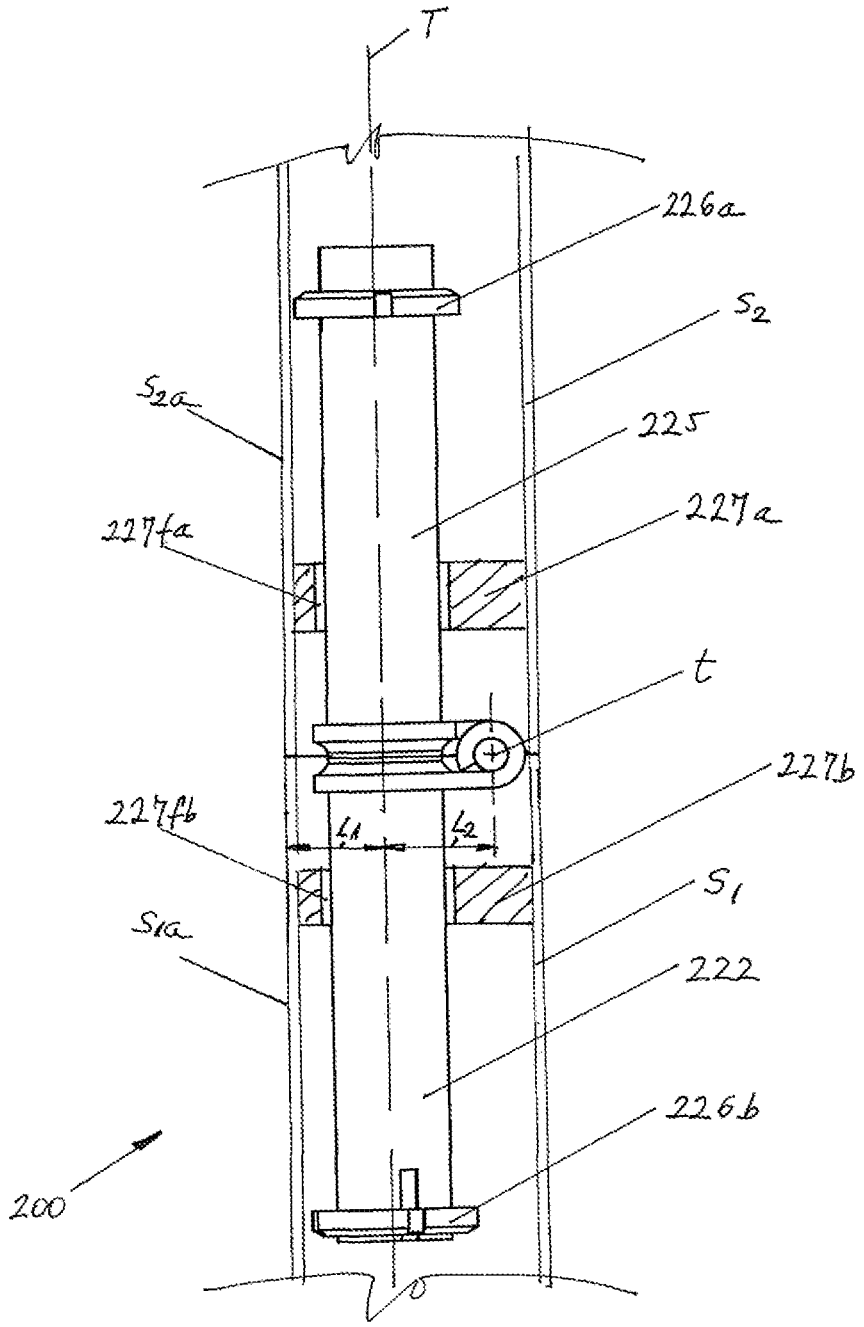

FIGS. 6*a* and 6*b* show a hinged member 200 in open state, as a further embodiment of the hinged member 20 of the present invention. The hinged member 200 has a cylindrical sliding block 222, which can move in the direction T of the bore 227*fb* and it can rotate about the axis T in the bore 227*fb* of a limiting member 227*b* fixed, e.g. welded, inside the section S1, not shown here. Similarly, a cylindrical locking member 225 can move in the direction T and it can rotate about the axis T in the bore 227*fa* having the same axis as the bore 227*fb* of a guide 227 fixed, e.g. welded to the section S2, inside the section S2. In a preferred embodiment, one of the sliding block 222 and locking member 225 may be secured to the respective guide 227*a*, 227*b*, while the other can be movable. The movable one of sliding block 222 and locking member 225 is provided with a stop element 226*a*, 226*b* having an outside diameter larger than the diameters of the holes 227*a*, 227*fb*. The hinged member 200 formed by sliding block 222 and locking member 225 connected together by means of a first bushing 221, a second bushing 223 and a pivot pin 224 having an axis t is located as a whole inside the sections S1, S2 in a closed state of sections S1, S shown in FIG. 6*b*, such that the minimum distance L1 between the and the axis T is smaller than a distance L2 between the outer wall S1*a* and S2*a* of the sections S1, S2 and the axis t of the pivot pin 224. In a state shown in FIG. 6*b* sections S1, S2 of column A cannot be rotated around the pivot pin 224 because all the points of the sliding block 222 and locking member 225 of the hinged member 200 would rotate around the axis t, while every points of sections S1, S2 of column A would turn around a line passing through a point P resulted in a stuck of the sliding block 222 and locking member 225 and guides 227*a*, 227*b*, that is the column A is in locked position.

Figure 6C:
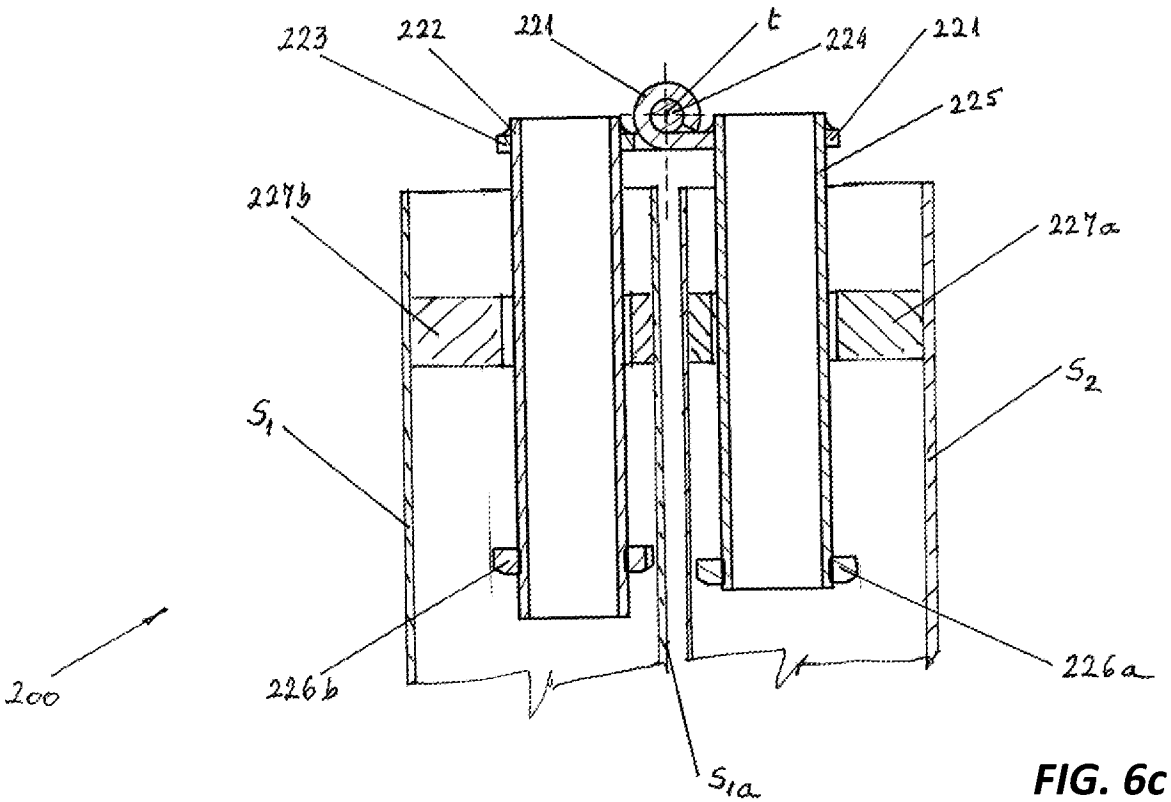

In FIG. 6*c* the hinged member 200 arranged in the section S1, S2 of column A is shown in its open position that is the container frame 1 is in folded position. It can be observed that, unlikely to the closed position shown in FIG. 6*b*, the axis t is located outside the plane of outer wall S1*a* of the section S1 of column A, which is a shift of positions that can be achieved during folding or installing the frame 1.

Figure 6D:
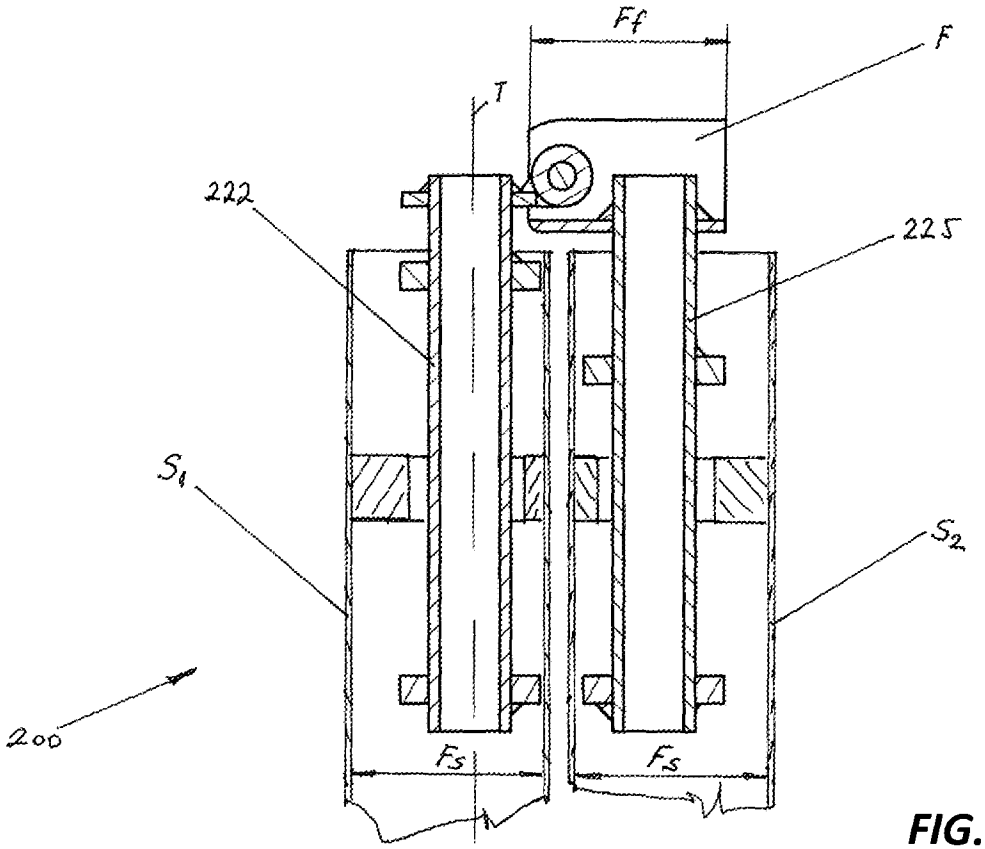

Hinged member 200 as shown in FIG. 6*d* is a further embodiment of hinged member 200 shown in FIG. 6*c*, which is provided with a locking head F, and column A is in open position. The width Ff of the locking head F is smaller than the inner size Fs of the sections S1, S2, so that if the column A is closed, i.e. in closed position, the head F is fitted into the cavity of sections S1, S2, e.g. into the cavity of hollow profiles used as sections S1,S2. After the sections S1, S2 got turned into the axis T by 180° around the axis t of the hinge pin, the hinged member 200 can be rotated by 180° around the axis T and the ends of the sections S1, S2 can be aligned, while the locking head F is fitted in inside of column A.

Figure 7:
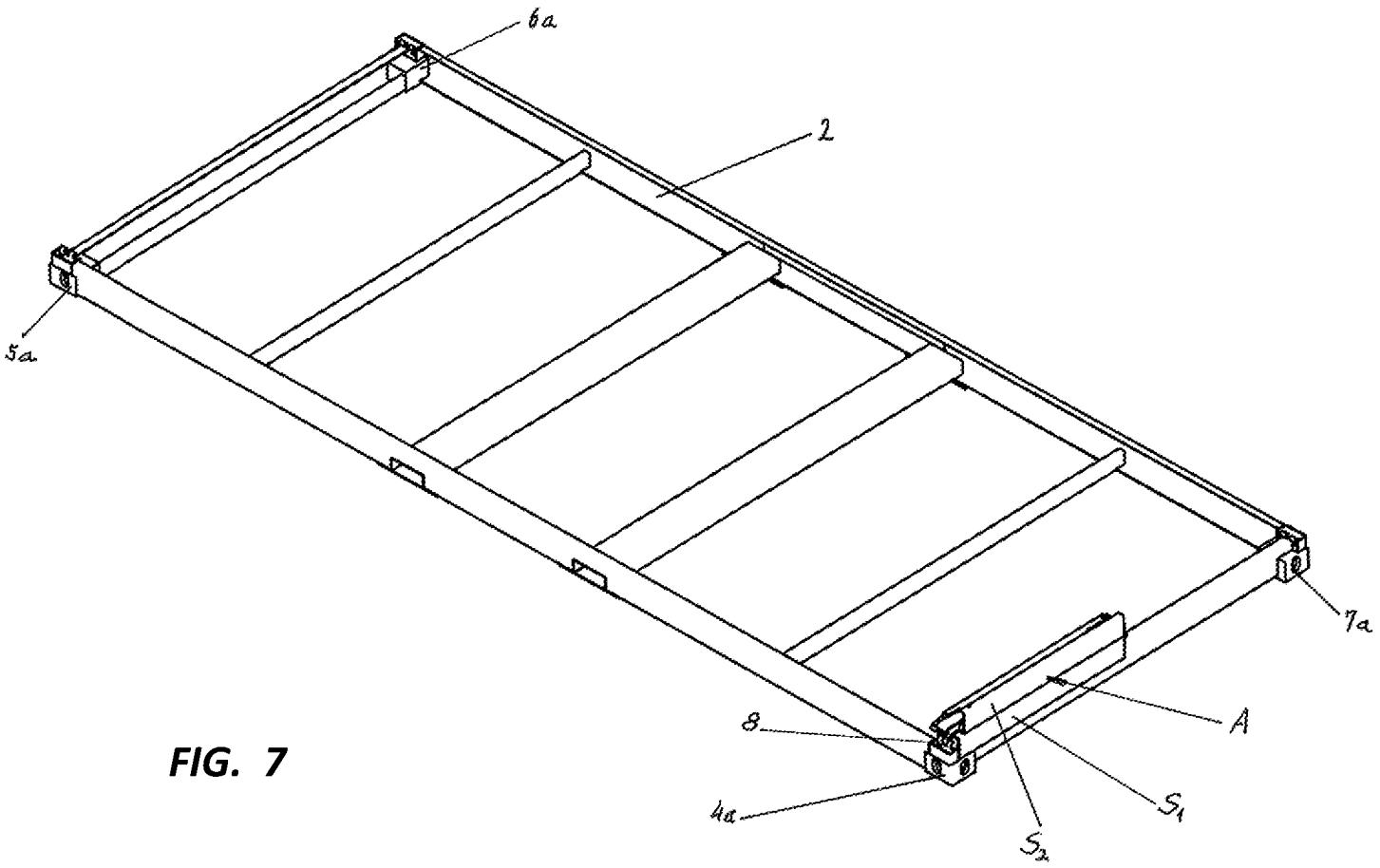
FIG. 7 shows column of the frame in folded position, before installation or after folding, with only one column depicted and without the upper mount.

In order to install the container frame 1 according to the invention, the collapsed container frame 1 is delivered to the site of installation intended, while at least two preferably multiple collapsed container frames 1 can be transported in a place of a single open container frame 1 or of the volume of a single conventional container. In that transport position, the column A and thus the columns B, C, D are in folded position, as shown in FIG. 7, and the hinged member of the column is, therefore, in open state. The container frame 1 is to be slung to a hoisting machine, e.g. a crane, by means of a rope fastened to the corner blocks 4*t*, 5*t*, 6*t*, 7*t* shown in FIG. 1, or other suitable means, e.g. by lifting the upper mount 3 with a lifting machine, e.g. a lift truck. When the upper mount 3 is raised, the sections S1, S2 of the columns A, B, C, D rotate around the hinges 8,9,10,11,12,13,14,15 and the columns A, B, C, D getting aligned along the axis T, while the sections S1, S2 rotate around the axis t of the pivot pins 24, 224 relative to each other. The lifting is continued until the stoppers 26,226*a*, 226*b* abut with guides 27,227*a*, 227*b*. Then, if a hinged member 20 according to embodiment shown in FIG. 3 is applied, the upper mount 3 is lowered and the sections S1, S2 in contact with each other form closed columns A, B, C, D, which cannot be folded again without lifting the upper mount 3. In a case when a hinged member 200 according to the embodiment shown in FIG. 6*a* is used, after stoppers impacted against the guides 27,227*a*, 227*b*, hinged member 200 is rotated about the axis T into the position shown in FIG. 6*b*, that is by 180°, so that the entire length of the hinged member 200 is placed inside the sections S1 and S2 and within their extension as a whole, and then the upper mount 3 is lowered and sections S1, S2 getting in contact with each other to form a closed and locked column A, B, C, D.

Thereafter, the container frame 1 may be provided with side walls and/or the frame/roof elements covering/filling the mounts 2, 3, if necessary. On the sidewalls window and door openings can be formed of course, and the container frames 1 set up can be placed side by side or can be stacked depending on the type of use.

The advantage of the foldable container frame 1 according to the present invention in relation to prior art solutions is that its fastening and hinging elements are unavailable to the user of the container frame 1 once installed, which can be disengaged by means of mechanical force only, and it can be optionally provided for different shipment purposes, for example with solid sidewalls and doors, windows and other walls, including but not limited to roofs and floor panels e.g for transporting, storing, or the container frame can be used for applications with no coverings are partially or totally in demand, and either transporting, installing and locking, or disengaging its latches and folding the container frame 1 is equally fast, easy, economical and safe as well.

The invention claimed is:

1. A foldable frame (1) for containers, comprising:

a polygonal base mount (2) made of studs (45,56,67,74); and a polygonal upper mount (3) parallel to the base mount (2) made of studs (4*a*5,5*a*6,6*a*7,7*a*4) and having a number of angles equal to those of the base mount (2), said polygonal base mount and said polygonal upper mount connected together by columns (A, B, C, D) of equal length attached with hinges (8,9,10,11,12,13,14, 15) to corner blocks (4*a*, 5*a*, 6*a*, 7*a*, 4*t*, 4*a*, 6*a*, 7*a*, 4*a*, 6*a*, 7*a*, 5*t*, 6*t*, 7*t*) provided at connections of the studs (45,56,67,74, 4*a*5,5*a*6,6*a*7,7*a*4), and the columns (A, B, C, D) are formed of at least two sections of the same length (S1, S2) and adjacent sections (S1, S2) of said at least two sections are joined together by a hinged member (20,200), at least one of said adjacent sections (S1, S2) is provided with an inner cavity, and the hinged member (20, 200) contains a first bushing (23,223) connected to a sliding block (22,222) movably disposed in the inner cavity of a first section (S1) of said adjacent sections, a second bushing (21,221) having common axle (t) with the first bushing (23,223) and secured to a locking member (25,225) arranged at least in part in the inner cavity of a second section (S2) of said adjacent sections, and a hinge pin (24,224) provided in the bushings (21,23, 221,223), and wherein at least one of the sliding block (22, 222) and the locking member (25,225) are movable along a longitudinal direction (T) of the columns (A, B, C, D), and a guide (27,227*a*, 227*b*) for restricting displacement of the sliding block (22,222) or the locking member (25,225), respectively, is fixed in the inner cavity of at least one section (S1, S2) of said adjacent sections, and a stopper (26,226*a*, 226*b*) is formed on the sliding block (22,222) and/or the locking member (25,225).

2. The foldable frame for containers (1) according to claim 1, wherein the hinged member (200) is rotatable around the direction (T) of the columns (A, B, C, D).

3. The foldable frame for containers (1) according to claim 2, wherein the guide (27,227*b*) is provided on at least one of the sliding block (22,222) and the locking member (25,225).

4. The foldable frame for containers (1) according to claim 3, further comprising a relative angular position of the hinged member (200) and a respective column (A, B, C, D) of the columns around the axis (T), at which a smallest distance (L1) of outer walls (S1*a*, S2*a*) of the sections (S1, S2) is smaller than a distance (L2) of the shaft (T) and the axis (t) of the hinge pin (224).

5. The foldable frame for containers (1) according to claim 4, wherein the sliding block (22, 222,) is provided with a latch head (F).

* * * * *